United States Patent [19]

Sprague

[11] Patent Number: 4,957,232

[45] Date of Patent: Sep. 18, 1990

[54] HAND WIPE HOLDER

[76] Inventor: Gailen Sprague, 7759 Greenbush Ave., Van Nuys, Calif. 91402

[21] Appl. No.: 345,205

[22] Filed: Apr. 28, 1989

[51] Int. Cl.[5] ..... A45F 5/00

[52] U.S. Cl. ..... 224/253; 224/249; 224/250; 224/904

[58] Field of Search ..... 224/163, 249, 253, 250–252, 224/904, 182, 226, 255; 294/8.5; 24/3 R, 3 M, 530, 570; 273/55 C; 2/48; D6/546, 608; 248/309.1, 316.2, 316.3, 211; 269/3, 87.2, 900, 902, 46

[56] References Cited

U.S. PATENT DOCUMENTS

| | | | |
|---|---|---|---|
| 331,728 | 12/1885 | Murphy | 248/309.1 |
| 1,086,200 | 2/1914 | Michie | D6/546 |
| 2,264,957 | 12/1941 | Shafarman | 211/60.1 |
| 2,513,846 | 7/1950 | Collins | D6/546 |
| 2,516,311 | 7/1950 | Ganz | D6/546 |
| 2,754,532 | 7/1956 | Kanehl et al. | 2/48 |
| 4,224,712 | 9/1980 | Black et al. | D6/608 |
| 4,631,783 | 12/1986 | Hayashi | 211/70.6 |

*Primary Examiner*—Henry J. Recla
*Assistant Examiner*—Keith Kupferschmid
*Attorney, Agent, or Firm*—Freilich, Hornbaker & Rosen

[57] ABSTRACT

A holder is described for releasably holding a hand wipe at a workman's belt or other clothing location, which enables holding of common wipes without any alteration to the wipes. The holder includes a body formed of flexible but tough material and having a band portion that fits around a workman's belt and having a wipe-receiving portion with a vertical tapered slot. A workman projects the corner of a hand wipe into the upper wide end of the slot and slides the hand wipe down along the slot to the narrow lower end thereof.

3 Claims, 1 Drawing Sheet

FIG. 1
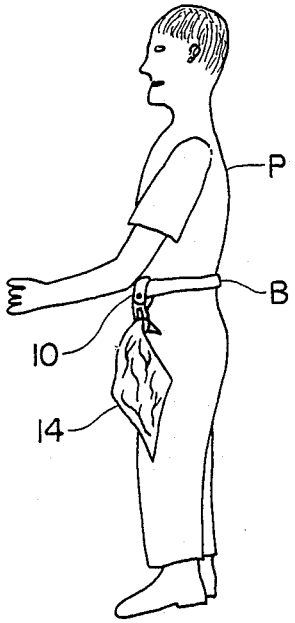
FIG. 2
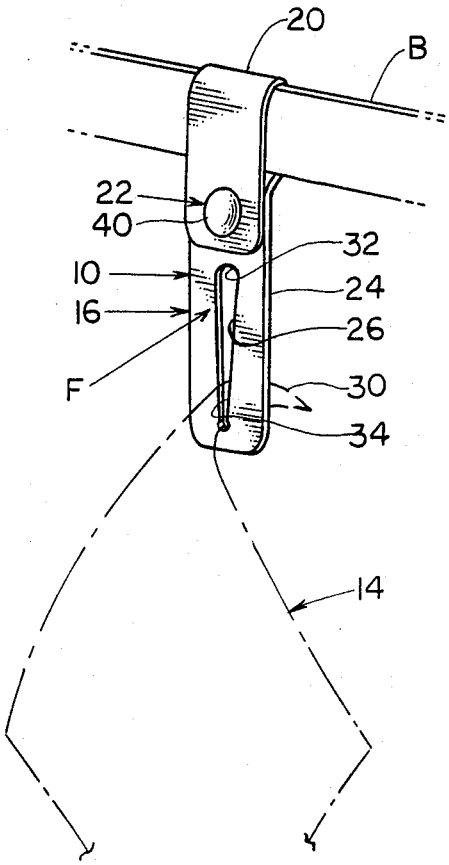
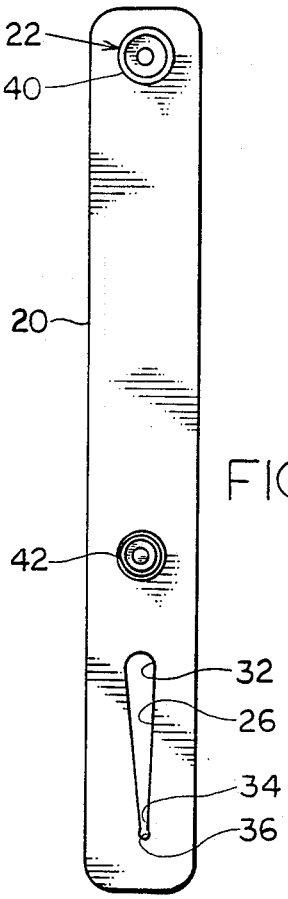
FIG. 3
FIG. 5
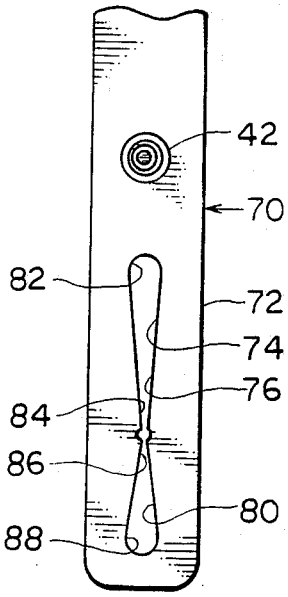
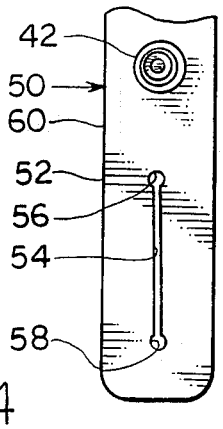
FIG. 4

HAND WIPE HOLDER

BACKGROUND OF THE INVENTION

Hand wipes such as small cotton towels, are used by workman to wipe oil and other dirt from their hands, and for other wiping purposes. If the wipes are merely laid on machinery, then they may easily fall off and there may be no specific place where the wipe is always laid. The wipe can be held to the workman as by tucking it under his belt, but it may fall off if the workman's belt is loose.

Many devices have been designed to hold hand wipes at a worker's belt. However, such devices have required alterations of the hand wipe, as by sewing a Velcro strip to one corner. Such approaches do not allow an ordinary hand wipe as provided by suppliers to be easily held. A holder which could securely but releaseably hold a hand wipe, without requiring any alternations to an ordinary hand wipe, would be of considerable value.

SUMMARY OF THE INVENTION

In accordance with one embodiment of the present invention, a hand wipe holder is provided which securely but releaseably holds a hand wipe without requiring any alterations to the hand wipe. The holder includes a body with a mount portion for supporting the rest of the body on a support such as a worker's belt or a specified place on machinery. The body also has a wipe-receiving portion with walls forming an elongated slot for receiving a hand wipe, by projecting a corner of the hand wipe into the slot.

In one holder, the slot extends vertically and is tapered, with the upper end being the widest and the lower end being narrowest. A person projects a corner of the hand wipe through the widest part of the slot, and then slides the hand wipe corner down along the slot to the narrowest end of the slot. The body is formed of a sheet of tough but flexible material such as leather or a plastic sheet of comparable properties, so the walls of the slot can spring apart to receive a wipe, and then tend to spring together to hold the wipe in place.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of a hand wipe holder, shown mounted on the belt of a person and with a hand wipe in place.

FIG. 2 is a front perspective view of a portion of FIG. 1, with the hand wipe shown in phantom lines.

FIG. 3 is a rear elevation view of the hand wipe of FIG. 2, shown before mounting on a belt.

FIG. 4 is a rear elevation view of a hand wipe holder constructed in accordance with another embodiment of the invention.

FIG. 5 is a rear elevation view of a hand wipe holder constructed in accordance with another embodiment of the invention.

DESCRIPTION OF THE PREFERRED EMBODIMENTS

FIG. 1 illustrates a hand wipe holder 10 of the present invention, showing it mounted on the belt B of a workman or person P. A hand wipe 14 is removeably supported on the holder. As shown in FIG. 2, the hand wipe holder 10 includes a body 16 formed of a flexible but tough material such as leather, which includes a mount portion 20 for supporting the entire body 16 on a support, the particular support shown being a belt B, and the mount portion 20 is formed of a strip of the flexible but tough material, with parts of a snap assembly 22 at opposite ends of the mount portion. The mount portion can be looped around the belt and the snap parts snapped together as shown.

The body 16 also includes a wipe receiving portion 24 with walls forming an elongated slot 26. The corner portion or corner 30 of the wipe 14 is received in the slot, to hold the hand wipe on the worker until it is needed. At that time, the hand wipe can be pulled out of the slot and used to wipe machinery, the hands of the worker, etc.

As also shown in FIG. 3, the slot 26 extends vertically, with an upper wide end 32 and a narrow lower end 34 ending in a relief enlargement 36. The workman inserts the corner of the hand wipe in a forward direction F (FIG. 2) into the upper wide end 32 of the slot, and then slides down the corner until it lies in the narrower lower end 34. As discussed above, the body is formed of a flexible but tough material such as leather or a similar flexible plastic of a thickness on the order of 1/16th inch. As the corner of the wipe is slid down along the slot, it causes the walls of the slot at its lower end to flex apart to receive the wipe. The flexing slot walls help to hold the wipe in the slot.

The hand wipe can be removed by either pulling it hard with a force such as 20 pounds, or by sliding up the corner of the hand wipe to the top of the slot, where it can be removed with little force. If the hand wipe should be caught on machinery, it will pull out of the slot with a moderate force such as 20 pounds (preferably less than one-quarter the weight of the average worker, or in other words less than 40 pounds) to avoid danger to the worker from having him drawn into machinery on which the wipe has caught.

The holder is formed from a strip of the flexible but tough sheet material, with the slot punched in the sheet and with snap parts 40, 42 installed as shown. The top of the body is inserted upwardly between the belt and pants of the wearer, is folded or looped around the front of the belt, and the snap parts 40, 42 are snapped together. The slot 26 then extends substantially vertical, and is ready for reception of the corner of a hand wipe. The hand wipes can be ordinary hand wipes with no alterations to them, in that no fastener or the like has been added to an ordinary square cloth hand wipe.

FIG. 4 illustrates a portion of another holder 50 with a wipe-receiving portion 52 having an elongated vertical slot 54 of substantially constant width, except for enlargements 56, 58 at the top and bottom for stress relief. The corner portion or corner of a hand wipe is pushed through the middle of the height of the slot, with the walls of the slot being flexible to permit such insertion but thereafter tending to spring back to hold the hand wipe in position. The flexible but tough sheet forming the body 60 of the holder is preferably somewhat thinner than that of the holder of FIGS. 1–3, to facilitate insertion and removal with moderate force. The constant diameter slot generally requires greater force to initially insert the corner of the hand wipe, and then to remove it. However, the hand wipe with constant diameter slot can be constructed of thinner material while securely holding the wipe because all of the inserted part of the wipe is closely held instead of only that part at the bottom of a tapered slot. When the wipe in the constant diameter slot is suddenly pulled down and out, as when caught in machinery, it can require a lower force to pull out the wipe because the wipe is not initially pulled further down into the narrowest part of the slot of a relatively thick holder.

FIG. 5 illustrates another holder 70 which has a somewhat longer wipe-receiving portion 72, to form a somewhat longer slot 74. The slot 74 has an upper region 76 of the same construction as the slot 26 of FIG. 3, and a lower region 80 where the slot is tapered to have a progressively greater width at lower locations. A workman inserts a corner portion of a hand wipe into the wide upper end 82 of the upper region 76, and slides down the corner until it lies between the narrow ends 84, 86 of the upper and lower slot regions or at one of them. The workman can easily remove the hand wipe by moving it down to the wide lower end 88 of the lower slot region 80 and pulling out the wipe.

The mount portion of any of the hand wipe holders can be adapted for mounting not only on the belt of a worker, but alternatively on the belt loops of his pants, on other clothing locations, or on a wall or machinery. A variety of mount designs are known for such mounting.

Thus, the invention provides a hand wipe holder which securely holds a hand wipe until it is needed, at which time it can be pulled out, which does not require any modification to a common hand wipe. The holder includes a mount for mounting to a belt of a person, or to some other support, and includes walls forming an elongated slot for receiving a corner portion of the hand wipe. The holder is formed of a sheet of flexible but tough material, at least at the portion forming the slot, to enable the slot walls to easily separate to receive the wipe, and to then tend to flex together to securely hold the wipe in position.

Although particular embodiments of the invention have been described and illustrated herein, it is recognized that modifications and variations may readily occur to those skilled in the art and consequently it is intended to cover such modifications and equivalents.

What is claimed is:

1. A hand wipe holder, comprising:

a sheet-like body having a band portion of a length to fit around the top of a person's belt and having fasteners that fasten opposite ends of said band portion together to avoid it falling off the belt;

said body having a wipe-receiving portion depending from said band portion, said wipe-receiving portion forming a primarily vertical tapered slot with its upper slot end widest to initially receive the corner of a hand wipe and with its lower slot end narrowest to grip the hand wipe when it is forced down along the slot.

said sheet-like body being formed of flexible but tough material with said slot formed as a hole therein, said slot walls flexing apart to receive the wipe and thereafter resiliently pressing toward each other to securely hold the wipe in place.

2. The holder described in claim 1 including:

a hand wipe having a corner portion projecting through said lower slot end, and with the rest of the hand wipe hanging down therefrom.

3. The holder described in claim 1 wherein:

said body has a second slot lying below said first slot, said second slot being tapered with its lowest end widest and its upper end merging with the bottom of said first mentioned slot.

* * * * *